United States Patent [19]

Lin

[11] Patent Number: 4,924,747

[45] Date of Patent: May 15, 1990

[54] WAVE FORMING CIRCUIT OF AN ELECTRONIC TONE GENERATOR

[75] Inventor: Shyuh-Der Lin, Hsin-Chu, Taiwan

[73] Assignee: Industrial Technology Research Institute, Taiwan

[21] Appl. No.: 394,319

[22] Filed: Aug. 14, 1989

Related U.S. Application Data

[63] Continuation of Ser. No. 31,893, Mar. 30, 1987, abandoned.

[51] Int. Cl.[5] ..... G10H 1/057; G10H 5/00

[52] U.S. Cl. ..... 84/663; 84/665; 84/DIG. 23

[58] Field of Search ..... 84/663, 665, 667, 668, 84/702, 703, 711, 713, 714, DIG. 23; 381/36; 307/200.1, 264, 268, 304

[56] References Cited

U.S. PATENT DOCUMENTS

| | | | |
|---|---|---|---|
| 4,018,125 | 4/1977 | Nishimoto | 84/1.26 X |
| 4,028,979 | 6/1977 | Luce | 84/1.24 |
| 4,160,402 | 7/1979 | Schwartz | 84/1.26 X |
| 4,173,916 | 11/1979 | Inoue et al. | 84/1.13 X |
| 4,210,053 | 7/1980 | Kimura | 84/1.01 |
| 4,213,367 | 7/1980 | Moog | 84/1.1 X |
| 4,273,019 | 6/1981 | Goto | 84/1.24 |
| 4,306,480 | 12/1981 | Eventott et al. | 84/1.01 |
| 4,408,514 | 10/1983 | Suzuki | 84/1.24 |
| 4,545,279 | 10/1985 | Sano | 84/1.26 |
| 4,559,602 | 12/1985 | Bates, Jr. | 381/36 X |
| 4,567,806 | 2/1986 | Kodaira | 84/1.26 |

*Primary Examiner*—Stanley J. Witkowski

*Attorney, Agent, or Firm*—Cahill, Sutton & Thomas

[57] ABSTRACT

Circuitry for an electronic tone generator effectively isolates a tone modulating RC network from the electroacoustic output device and associated volume control systems. This isolation prevents low or variable impedance of the output portion of the generator from adversely affecting the charge and discharge rate of the RC network. Isolation circuitry includes a MOSFET connected in a source follower circuit to convert the voltage signal from the RC network to a comparable current signal which is amplified through a pair of MOSFETs in a current mirror circuit.

4 Claims, 2 Drawing Sheets

WAVE FORMING CIRCUIT OF AN ELECTRONIC TONE GENERATOR

This application is a continuation of application Ser. No. 07/031,893 filed Mar. 30, 1987 and now abandoned.

TECHNICAL FIELD

This invention is concerned with tone generators, especially those for synthesizing music.

BACKGROUND ART

It has become fairly common practice in the design of electronic tone generators to employ resistor-capacitor circuits, or networks, (RC networks) to amplitude modulate the tone signals. The rapid charge of a capacitor and its subsequent discharge through a resistor produces a decaying voltage waveform similar to tones produced by musical instruments.

U.S. Pat. No. 4,273,019, granted June 16, 1981, to M. Goto for "Electronic Tone Generator" and No. 4,545,279, granted Oct. 8, 1985, to T. Sano for "Electronic Music Note Generator", disclose tone generators employing RC networks for shaping tone waveforms.

In theory, the waveform generated by the RC network in the generators disclosed in the above-mentioned patents can be predetermined by proper selection of values for the capacitor and the resistor and by control of the value and duration of the voltage applied to the network. In practice discharge rate of the capacitor is influenced by the impedence of components to which the output of the RC network is applied, such as an electroacoustic output device and an amplifier therefor. Unless the impedence of these other components is kept high, leakage from the capacitor through these other components alters the waveform intended to be produced by the RC network. This in turn results in the generation of sound different than that intended.

In the past it has been the practice to design and fabricate the output portions, i.e. the electroacoustic device and its amplifier, to exhibit high impedence by, for example, employing a Darlington pair transistor circuit as an amplifier. The disadvantages of doing this are that it increases the cost of the generator circuit and requires that a higher operating voltage be employed.

The problem of waveform distortion from capacitor leakage has been even more acute with tone generators having a variable resistor in the circuit for controlling the volume of tones emitted by the electroacoustic device. Obviously, adjusting the variable resistor changes the impedance of the load on the RC network and this adversely affects the waveform signal from the RC network.

DISCLOSURE OF THE INVENTION

This invention isolates the RC network of a tone generator from the electroacoustic output device and its associated components. Isolation is accomplished primarily by a source follower MOS transistor having its gate connected to the output of the RC network. The current output from the MOS transistor exhibits substantially the same waveform as the voltage output from the RC network. This current output is preferably fed through a pair of MOS transistors connected in a current mirror circuit which further isolates the RC network from the remaining load portion of the generator circuitry.

With the RC network effectively isolated from the remainder of the circuit it becomes possible to employ a variety of techniques of volume control including the use of variable resistors at different locations without influencing the performance of the RC network. In a further embodiment the employment of multiple transistors for tone signal input permits the volume of each note of music to be programmed.

BRIEF DESCRIPTION OF THE DRAWING

The invention is described in greater detail hereinafter by reference to the accompanying drawings wherein.

BEST MODE FOR CARRYING OUT THE INVENTION

Figure 1:
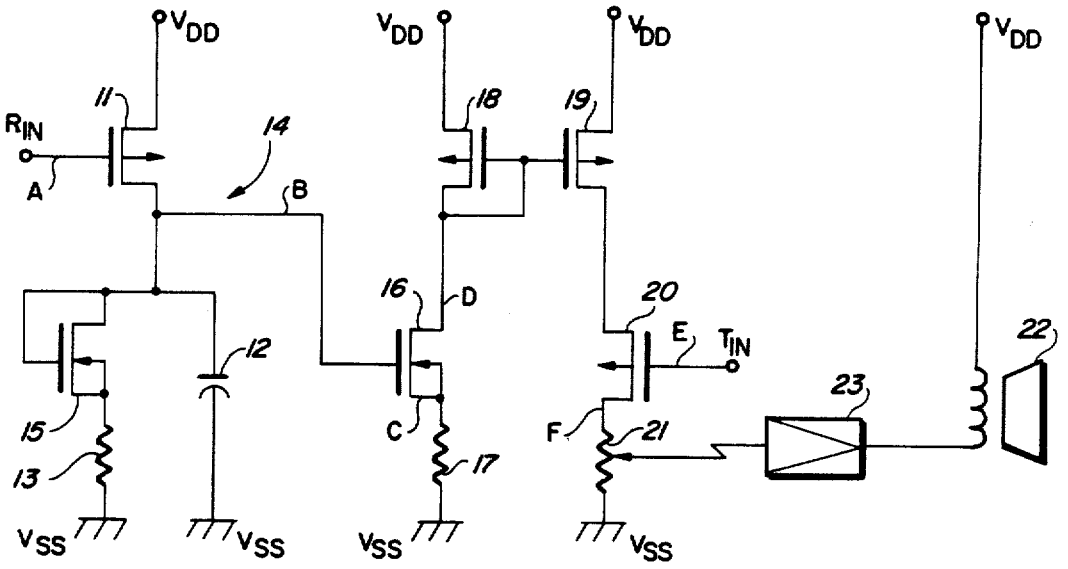
FIG. 1 is a circuit diagram for an electronic tone generator embodying this invention.
Figure 2:
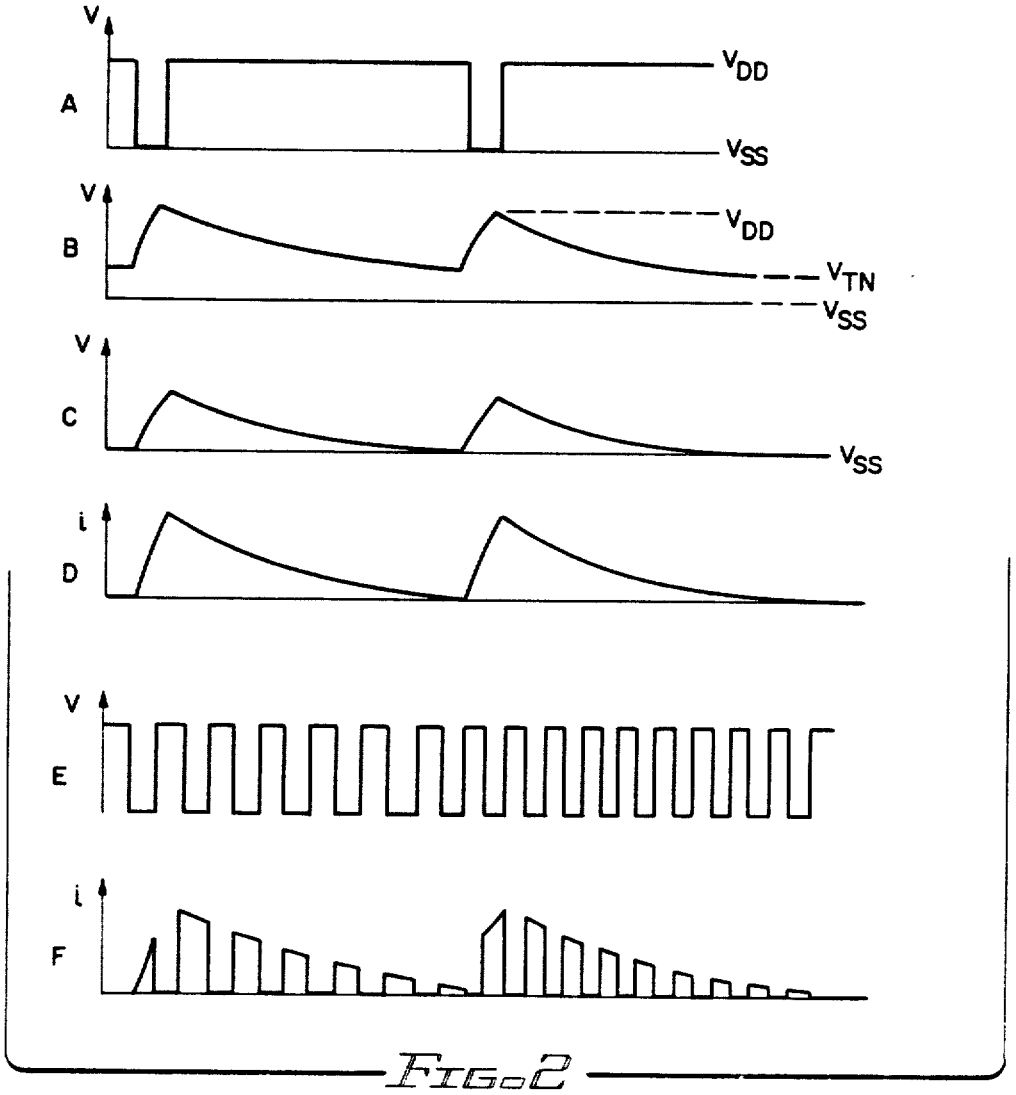
FIG. 2 illustrates waveforms associated with the circuit of FIG. 1.

Referring particularly to FIG. 1, initiation of generation of a tone by the circuit there illustrated is effected by imposition of a rhythm signal on terminal $R_{IN}$. That signal, which may have the waveform illustrated at A in FIG. 2, is conveyed to the gate of a P-channel MOSFET 11. Note that letter A in FIG. 1 identifies the location of the signal having the waveform A in FIG. 2. Other letters appearing in FIGS. 1 and 2 convey similar information.

The function of MOSFET 11 is to trigger initiation of a tone. It is connected to a voltage source $V_{DD}$ in series with a capacitor 12 and resistor 13. Capacitor 12 and resistor 13 are in parallel and are connected to a second voltage source $V_{SS}$, which may be ground. Transistor 11, capacitor 12 and resistor 13 comprise an RC network, generally indicated by reference numeral 14. When the gate of transistor 11 is subjected to a low voltage pulse (waveform A of FIG. 2) the transistor turns on, connecting capacitor 12 to $V_{DD}$ for a brief period to rapidly charge the capacitor. When the gate of transistor 11 is returned to a higher voltage level the transistor turns off and the charge in capacitor 12 gradually leaks through resistor 13 to voltage source $V_{SS}$.

The RC network 14 employed in this invention also preferably comprises a diode connected N-channel MOSFET 15 connected in series with resistor 13. Transistor 15 serves to limit discharge of capacitor 12 to insure an output voltage from the RC network 14 at some level above $V_{SS}$. As the voltage impressed on the gate of transistor 15 approaches the threshold voltage $V_{TN}$ of the transistor it shuts off, inhibiting further discharge of capacitor 12.

The resulting voltage waveform from the RC network 14 at point B in the circuit appears as waveform B in FIG. 2. Waveform B is characterized by exhibiting rapidly increasing voltage during an attack portion while the capacitor 12 is being charged and an exponential decay portion while the capacitor 12 is discharging through resistor 13. The voltage in waveform B decreases only to $V_{TN}$ of transistor 15.

Voltage waveform B from the RC network 14 closely approximates the amplitude envelope of tones produced by musical instruments. And this output from the RC network is utilized, as has been done in prior art tone generators, to amplitude modulate a tone signal to synthesize a musical note. Unlike prior art tone generators, however, the RC network output signal in this invention is not employed directly to drive an electroacoustic output device, but rather is isolated therefrom by intermediate circuitry.

The isolating means, or circuit, includes a source follower N-channel MOSFET 16 having its gate connected to the output of RC network 14. Transistor 16 has its source connected to $V_{SS}$ through a resistor 17. Transistor 16 and resistor 17 together act as a level-shift and source follower with respect to voltage waveform B imposed on its gate from RC network 14. A downshift voltage waveform C in the image of waveform B is generated at the source of transistor 16. The resulting current flow through transistor 16 is that illustrated as waveform D. This current appears at location D in the circuit of FIG. 1 and flows through another diode connected, P-channel MOSFET 18 which is connected to voltage source $V_{DD}$.

A current corresponding to waveform D and flowing through transistor 18 initiates a like current in another P-channel MOSFET 19. Transistors 18 and 19 are connected in parallel to $V_{DD}$ and have their gates connected to establish a current mirror in which the current through transistor 19 is proportioned to the current flow through transistor 18. The current in transistor 19 is, therefore, of the same waveform as that illustrated at D in FIG. 2. In other words, it has the same attack and decay characteristics as the output of RC network 14.

The current waveform D in transistor 19 is utilized to amplitude modulate a tone signal introduced into the circuit through another P-channel MOSFET 20. The gate of transistor 20 is connected to a tone input $T_{IN}$ and receives a voltage waveform E corresponding to the frequency of the tone to be produced. Transistor 20 is switched on and off rapidly at this frequency with the result that the current therethrough, under the combined control of series connected transistors 19 and 20 takes the amplitude modified waveform illustrated at F of FIG. 2. The memory supplying the tone signal to $T_{IN}$ is programmed to produce different frequency tone signals for different notes of the music to provide a melody.

The electrical circuit through transistors 19 and 20 is completed by connection to $V_{SS}$ and may include a variable tap resistor 21. Adjustment of resistor 21 controls the amount of current supplied through an amplifier 23 to an electoacoustic output device, such as a speaker 22. The other connection to speaker 22 is to $V_{DD}$. The arrangement is such that resistor 21 serves as a volume control means over the audio output of speaker 22.

It is especially to be noted that the impedance of the speaker 22 and the amplifier 23 and the variable impedence offered by variable resistor 21 have no influence whatsoever on the charge-discharge characteristics of RC network 14. The latter is fully and effectively isolated from any load created by resistor 21, speaker 22 and amplifier 23 by source follower transistor 16 and current mirror transistors 18 and 19. This is one of the principal distinguishing features of this invention over the prior art.

Figure 3:
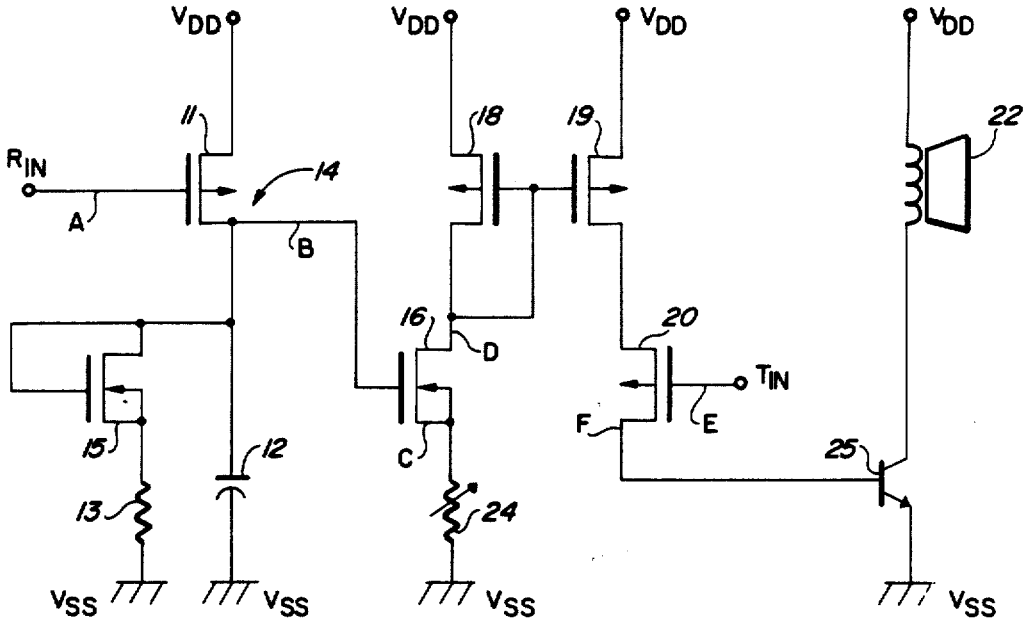
FIG. 3 is a circuit diagram illustrating another mode for carrying out the invention.
Figure 4:
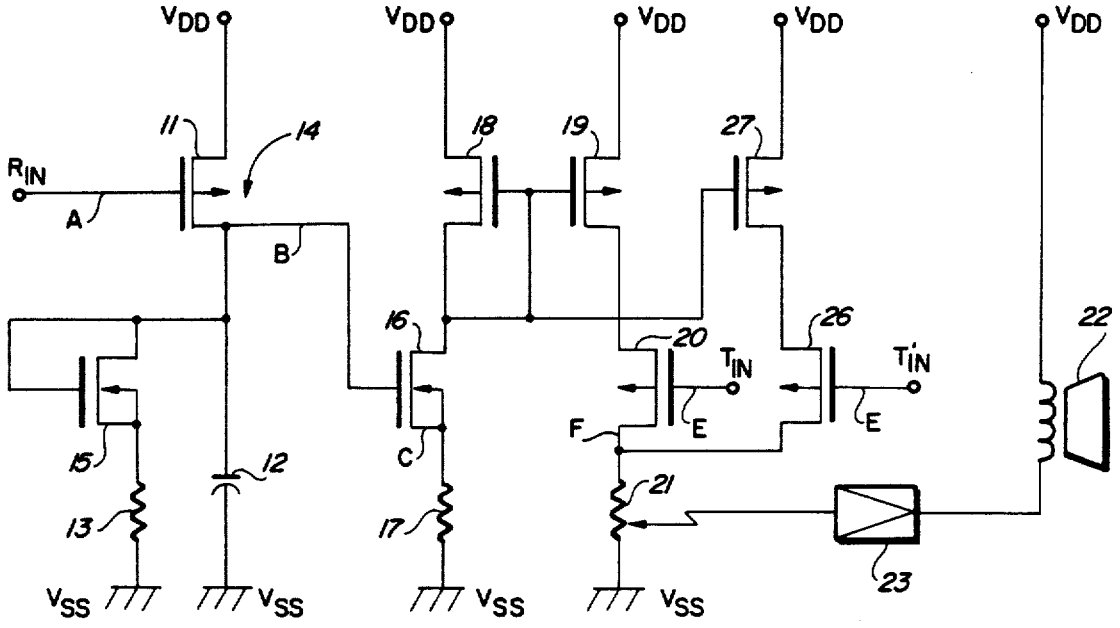
FIG. 4 is another circuit diagram illustrating a further mode for out the invention.

FIGS. 3 and 4 illustrate other modes for carrying out the invention. In these figures the circuit components which are the same in construction and function as the components described above by reference to FIG. 1 are identified by the same reference numerals used in FIG. 1. Reference can be had to the preceeding description for the operation of these components.

The circuit illustrated in FIG. 3 differs from the FIG. 1 circuit in only two respects. First, the volume control means is a variable resistor 24 associated with source follower transistor 16. Adjusting resistor 24 changes the current flowing through the output portion of the generator and, hence, the volume from speaker 22.

The second difference between the circuit of FIG. 3 and that of FIG. 1 resides in the use of a simple bipolar transistor 25 as an amplifier in an emitter circuit with speaker 22. Such a transistor could function equally well if connected in a collector circuit with speaker 22. In either of such circuits the bipolar transistor offers only low impedence. In circuits of the prior art this would be unacceptable because of the drain on the RC network resulting from the low impedence. However, with the isolation means of the present invention the load impedence is of no consequence in operation of the RC network.

The circuit illustrated in FIG. 4 differs from that illustrated in FIG. 1 in that it permits the audio output volume to be programmed and changed from tone to tone. This is accomplished through the use of multiple tone input transistors. It will be noted that the FIG. 4 circuit has a second tone input P-channel MOSFET 26 connected to a second tone input $T_{IN}$. Transistor 26 is in parallel with tone input transistor 20 and in series with another current mirror transistor 27 which is parallel with current mirror transistor 19. One tone input transistor, say 20, can be employed to input tone signals of a particular amplitude while another transistor 26 can be employed to imput tone signals of a different amplitude . Additional input transistors can be similarly connected to supply signals of other amplitudes. Programmed into the memory of the integrated circuit embodying the tone generator is information for selecting the particular tone input and its programmed amplitude. Because the volume of the audio signal from speaker 22 is determined by the amplitude of the signal supplied thereto the volume is thereby controlled note by note.

It will be noted that waveforms produced throughout all three circuits, FIG. 1, 3 and 4, are essentially the same. Therefore, the waveforms illustrated in FIG. 2 are appropriate for all three circuits.

The improved tone generators of this invention will be observed to have further desirable operating characteristics by virtue of isolating the RC network from the remainder of the circuit. With the improved generator neither the volume nor the time duration of a tone will affect the volume of the succeeding note. In prior art generators any stored charge remaining in the condensor of the RC network at the initiation of a new rhythm charge affects the total voltage charged for the succeeding tone and this influences the volume of the succeeding note. Such effects are eliminated with the isolation means of the present invention.

What is claimed is:

1. An electronic tone generator employing an RC network comprising a capacitor capable of being charged and discharged and a resistor through which said capacitor is discharged and in which the charging and discharging of the capacitor is utilized to amplitude modulate a tone signal, and the modulated tone signal is converted to audible sound by an electroacoustic output device, the improvement comprising a first MOS transistor in said RC network for limiting the discharge of said capacitor through said resistor, said transistor exhibiting a threshold voltage which enables said transistor to shut off to prevent complete discharge of said capacitor beyond the threshold voltage of said transistor, and means isolating said RC network from the impedance of said output device, said isolating means comprising a source follower second MOS transistor circuit between said RC network and said output device.

2. The tone generator of claim 1 further comprising a pair of transistors connected in a current mirror circuit between said source follower circuit and said output device.-

3. The tone generator of claim 1 further comprising at least two transistors connected in parallel for supplying tone signals to the tone generator between said isolating means and said output device, said two transistors supplying tone signals of different amplitudes.

4. The tone generator of claim 1 further comprising volume control means in the form of a variable resistor associated with said source follower circuit.

* * * * *